United States Patent [19]

Albaric et al.

[11] 4,200,784

[45] Apr. 29, 1980

[54] HOLLOW SHAFT BORE HEATER ASSEMBLY

[75] Inventors: Jacques E. Albaric, Nimes, France; Forrest E. Coyle, Pittsburgh; Thomas P. Sherlock, Lansdowne, both of Pa.

[73] Assignee: Westinghouse Electric Corp., Pittsburgh, Pa.

[21] Appl. No.: 857,481

[22] Filed: Dec. 5, 1977

[51] Int. Cl.[2] ..... H05B 11/02

[52] U.S. Cl. ..... 219/470; 219/535; 219/536; 290/2; 338/316; 415/121 A

[58] Field of Search ..... 219/200, 201, 205, 208, 219/469, 470, 471, 523, 530, 535, 536; 290/2; 415/121 A; 338/316; 339/5 C, 5 RL

[56] References Cited

U.S. PATENT DOCUMENTS

| | | | |
|---|---|---|---|
| 1,811,383 | 6/1931 | Brown | 415/121 A |
| 2,004,777 | 6/1935 | Bassler | 290/2 |
| 2,874,257 | 2/1959 | Kuhn et al. | 338/316 X |
| 2,875,312 | 2/1959 | Norton | 219/536 X |
| 3,151,633 | 10/1964 | Shuman | 219/530 X |
| 3,484,581 | 12/1969 | Bliss | 219/469 |
| 3,720,808 | 3/1973 | Morrissey | 219/469 |
| 3,997,758 | 12/1976 | Patil | 219/201 |

*Primary Examiner*—Volodymyr Y. Mayewsky
*Attorney, Agent, or Firm*—J. W. Keen

[57] ABSTRACT

A hollow, rotatable shaft bore heater assembly for heating a shaft from its inside to its outside. Rapid rotatable shaft heating is provided by a plurality of electrical heaters situated in slots formed on the inner surfaces of a plurality of foundation members which are insertable in the hollow shaft and are biased thereagainst by biasing structure. When assembled, the foundation members constitute a substantially cylindrical structure which has the slots formed on its inner surface and the electrical heaters are restrained within those axially extending and circumferentially separated slots by insulation disposed on the inner surface of the foundation members across the slots open mouths. The biasing structure provides biasing force between circumferentially adjacent foundation members so as to maintain contact between the shaft and foundation members during non-rotation of the shaft.

9 Claims, 3 Drawing Figures

HOLLOW SHAFT BORE HEATER ASSEMBLY

BACKGROUND OF THE INVENTION

1. Field of the Invention

This invention relates to hollow shafts of turbines, and more particularly, to means for heating the hollow shaft from its inside to its outside.

2. Description of the Prior Art

When large rotating apparatus such as steam turbines which normally operate at elevated temperatures are removed from service, access to the turbine by the steam or other heating medium is usually prevented and the turbine is either brought to rest or rotated at low RPM's by turning gears. To safely and reliably accelerate the steam turbine to synchronous speed and bring it under load, the turbine parts which are normally exposed to the hot, motive steam must be increased in temperature at a relatively slow rate to avoid high internal material stresses from being experienced. Such slow temperature increases are especially critical for the turbine's shaft since, in addition to the high thermal stresses experienced by it, high, centrifugally induced stresses are imposed upon it. To assure quick response to increasing load demand it has often been necessary for utilities to maintain an abnormally high spinning reserve of generating capacity. Such spinning reserve requires capital expenditures for additional equipment and often results in high operating costs for that equipment due to its relatively low efficiency at partload, normal demand operation. Reduction in the amount of spinning reserve necessitates having the capability of quickly accelerating steam turbines from turning gear operation to operating speed while avoiding high internal material stresses during such fast rotative acceleration and material temperature elevation.

U.S. Pat. No. 2,004,777 which issued June 11, 1935, discloses electrical heating of turbine casings and other associated stationary parts such as flanges. U.S. Pat. No. 1,811,383 which issued June 23, 1931, illustrates a system for preheating turbine components by continuously passing heating steam therethrough and removal of moisture droplets condensed within the turbine. Both of the aforementioned patents illustrate prior attempts to reduce turbine startup time by preheating selected parts of the turbine. Neither patent, however, illustrates heating the turbine shaft from the inside toward the outside. It can be shown that the shaft material near the bore experiences the highest centrifugal force stress loading and neither of the aforementioned patents provide means for directly heating the material in such region. Further attempts to heat turbine shafts from their inside include routing heating steam to the inside bore, but it has been found that such practice can promote stress corrosion cracking of the turbine shaft and is thus considered undesirable. It is to be noted that U.S. Pat. No. 2,004,777 illustrates electrical heating of the casing elements only and provides no means for preheating the rotatable shaft element. A further disadvantage of U.S. Pat. No. 1,811,383 is that it requires a continuous steam flow through the turbine to maintain the desirable temperature in all turbine parts. Such practice is expensive since it requires constant expenditure of heat energy to maintain turbine component temperatures at acceptable levels.

Supplying electrical energy to electrical heaters disposed within turbine shafts has heretofore presented a variety of problems. Ser. No. 857,480, filed Dec. 5, 1977, provides a solution to many of the problems that previously existed for conducting electricity from a stationary source to the turbine shaft's interior. Since such conduction is now practical, it is desirable to obtain an electrical turbine bore heating system which uses relatively simple electrical heaters which can be easily assembled in turbine shafts, will provide uniform heating, and will have heating capability sufficient to rapidly heat the turbine shaft from its interior.

SUMMARY OF THE INVENTION

In accordance with the present invention a shaft bore heater assembly is provided for heating a hollow shaft from its inside surface. The invention generally comprises a hollow, rotatable shaft which has a plurality of foundation members disposed inside, a plurality of electrical heaters disposed in open-mouth slots formed in the heater foundation members, means for restraining the heaters in those slots, and means for biasing the foundation member's outer surfaces into engagement with the shaft's inside surface.

A preferred embodiment of the invention includes heater foundation members which, when assembled, form a substantially cylindrical structure with the biasing means being disposed between circumferentially adjacent foundation members. Insulation attached to the inner surface of the foundation members promotes heat flux in the radially outward direction and acts to restrain the heaters within the slots by covering the slots' open mouths. The biasing means are restrained in biasing position by disposing portions thereof in indentations formed on circumferential ends of circumferentially adjacent foundation members wherein the biasing means induce engagement between foundation members and the shaft. The heater foundation member's slots are equally spaced in the circumferential direction and axially disposed to provide uniform heating of the shaft.

Electrical heating of the shaft from the shaft's inside to a temperature at or above the shaft's brittle to ductile transition temperature permits fast rotative acceleration of the turbine from low temperature, low speed operation to its normal, elevated operating speed and temperature while avoiding the possibility of catastrophic mechanical failure due to excessive internal stresses. Since the shaft material near the bore experiences the highest stresses under centrifugal loading, heating the shaft from its bore minimizes thermal stresses in that location and thus permits higher rotative acceleration than has heretofore been possible. Heating the shaft from its bore also reduces thermal stresses at the shaft's outer periphery since that outer periphery is normally cold when it is exposed to relatively hot, motive steam during incremental loading of the turbine.

BRIEF DESCRIPTION OF THE DRAWINGS

The invention will be more fully understood from the following detailed description of a preferred embodiment taken in connection with the accompanying drawings, in which.

DESCRIPTION OF THE PREFERRED EMBODIMENT

The present invention is concerned primarily with heating means for the inside of hollow, rotatable shafts. Accordingly, in the description which follows the invention is shown embodied in a large steam turbine. It should be understood, however, that the invention may be utilized as a heating means for a rotatable hollow shaft in any device.

Figure 1:
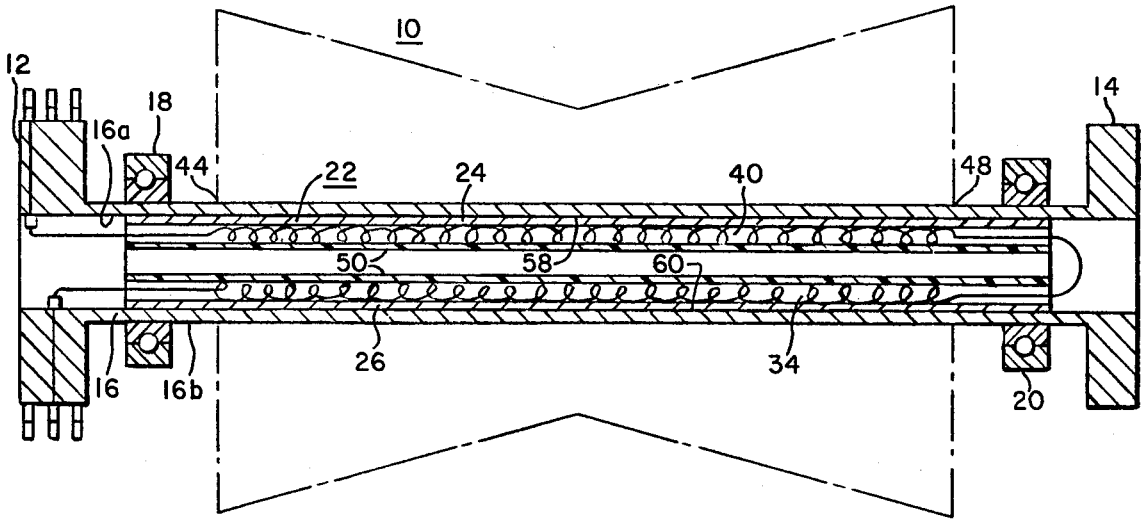
FIG. 1 is a partial transverse sectional view of a schematized turbine.
Figure 3:
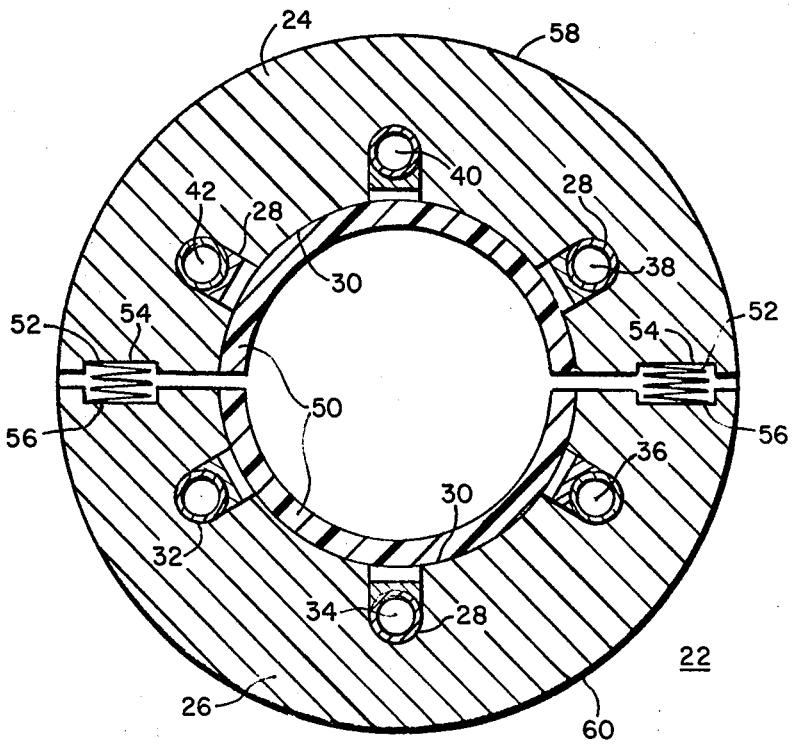
FIG. 3 is a sectional end view of a portion of the present invention.
Figure 2:
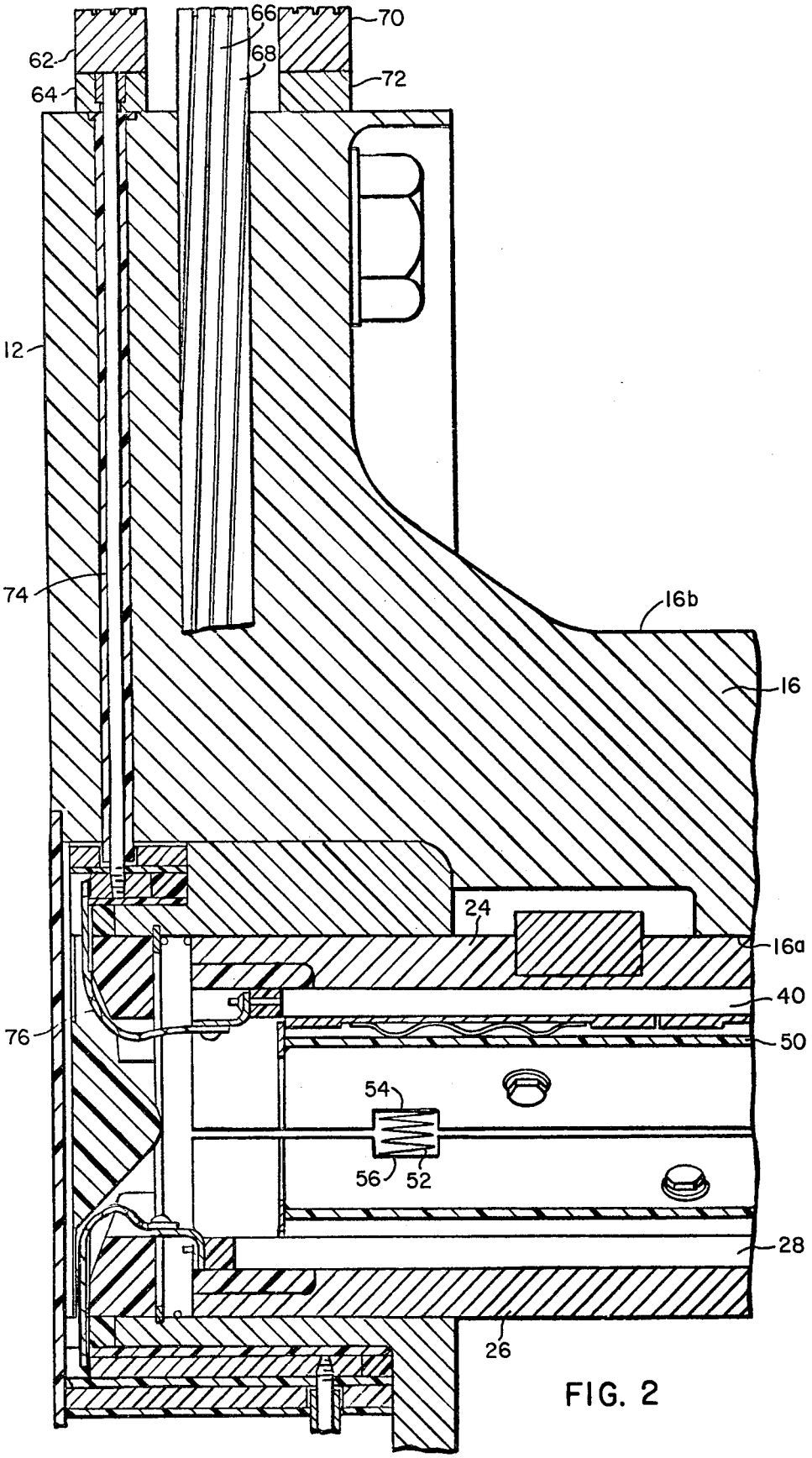
FIG. 2 is a partial sectional view of the turbine's electrical supply flange.

FIG. 1 schematically illustrates steam turbine 10 which is illustrated as being a double axial flow turbine. Generator end flange 12 and governor end flange 14 are situated on opposite axial ends of heat conductive turbine shaft 16 which is journaled between bearings 18 and 20. Shaft 16 is seen to be hollow with an inner surface 16*a* and outer surface 16*b*. Situated within shaft surface 16*a* is shaft heater assembly 22 better illustrated in FIG. 3. Shaft heater assembly 22 constitutes two half cylinder heater foundation members which are made of a material identical to or of the same nature as shaft 16. Heater foundations 24 and 26 have axially extending slots 28 formed on their radially inner surfaces 30 with the slots' mouths opening radially towards shaft 16's axis of rotation and with the slot's bottoms being disposed within the foundations. Tubular electric heaters 32, 34, 36, 38, 40, and 42 are distributed in slots 28 with their heating coils extending axially between the turbine's gland seals (not shown) normally situated at positions 44 and 48. The electrical heater's conductive elements, while shown schematically in FIG. 1, are electrically insulated from the foundation members 24 and 26. Insulation 50 is attached to inner surface 30 of heater foundations 24 and 26 and extends across the open mouths of the axially extending slots so as to restrain heaters 32 through 42 and spacers 49 therein during non-rotation of shaft 16. Spacers 49, illustrated in FIGS. 2 and 3, are shaped to cooperate with the tubular heaters and prevent penetration thereinto by biasing means such as wavy bias or leaf springs 51. Springs 51, as best illustrated in FIG. 2, are disposed between insulation 50 and spacers 49 to urge the electric heaters against the bottoms of their slots. Spring 51 for urging heater 34 was deleted for purposes of clarity. Biasing means such as springs or Bellville washers 52 are disposed in cooperating indentations 54 and 56 formed on circumferentially adjacent ends of foundation members 24 and 26 respectively. Indentations 54 and 56 restrain springs 52 within a relatively small radial distance as illustrated in FIG. 3 and a relatively small axial distance as illustrated in FIG. 2. Springs 52 and 54 permit the shaft bore heater assembly to be inserted and removed from shaft 16 with relative ease while maintaining good heat transfer contact between inner shaft surface 16*b* and both outer surfaces 58 and 60 of foundation members 24 and 26, respectively, during relatively slow shaft rotation or rest.

FIG. 2 is a partial transverse sectional view of electrical input generator flange 12 and its connection with heaters 34 and 40. For comparative purposes heaters 40 and 34 are illustrated in their non-heating and heating positions respectively. As can be seen, heater 34 is elongated in the axial direction due to thermal expansion from heat generated by that heater. Double rings 62, 64, 66, 68, 70, and 72 are illustrated along the outer periphery of flange 12. Conducting studs extending radially through flange 12 from inner rings 64, 68, and 72 provide electrical energy through flexible or braided connectors to the electrical heaters which constitute a portion of the present invention. The details of such double slip-ring construction are set forth in copending application Ser. No. 857,480, filed Dec. 5, 1977.

For illustrative purposes here, only copper stud 74 connecting slip ring pair 62 and 64 is shown in operating position providing electrical energy to heater 40 through flexible or braided conducting connector 76. Each pair of slip rings is connected to two heaters. The preferred embodiment has three-phase power supplied to the illustrated six heaters which are wired in delta.

Although delta wiring from a three-phase power supply to six electrical heaters has been indicated as preferred, it is to be understood that any number of electrical heaters may be utilized with any comparable single or multiphase power supply system and those heaters may be electrically wired in "Y" as well. Furthermore, any number of heater foundation members may be utilized to form the preferred, assembled cylindrical shape since the invention is not to be limited to dual semi-cylindrical foundation members.

It will now be apparent that an improved apparatus for heating turbine shaft bores has been provided in which electrical heaters are utilized to heat the turbine shaft from the inside so as to reduce thermal shock on the shaft from inlet steam at initiation of turbine operation and thus permit shorter turbine startup times due to greater allowable rotative acceleration rates. Furthermore, the turbine shaft bore heater assembly results in a mechanical stable structure whose life is substantially the same as the turbine's and whose failure will not adversely affect the turbine's start up time over those of prior startup methods. Such rapid startups permit better generating response to load demand and decrease the high cost sustained in present, lengthy turbine startups.

We claim:

1. A shaft bore heater assembly comprising:

a hollow, heat conductive rotatable shaft having an inside and an outside surface;

a plurality of heater foundation members having inner and outer surfaces, at least a portion of said outer surfaces being engageable with said shaft's inside surface, said members having open-mount slots in one of said surfaces, said slots having bottoms;

a plurality of electrical heaters insertable in said slots, said electrical heaters being electrically interconnected and having electrical leads at least at one axial end, said heaters being electrically insulated from said foundation members;

means for restraining said heaters in said slots; and means for biasing said foundation members' outer surfaces into engagement with said shaft's inside surface.

2. The shaft bore heater assembly of claim 1 wherein said foundation members are arcuate portions of a substantially cylindrical structure which obtains when said foundation members are assembled in operating position.

3. The shaft bore heater assembly of claim 2 wherein said biasing means are disposed between the circumferentially adjacent heater foundation members.

4. The shaft bore heater assembly of claim 3 wherein said biasing means are restrained in biasing position by disposing portions of said biasing means in indentations formed on the circumferential ends of the circumferentially adjacent foundation members.

5. The shaft bore heater assembly of claim 1 wherein said slots are equally spaced in the circumferential direction and axially disposed.

6. The shaft bore heater assembly of claim 1, said restraining means comprising:

means for covering the open mouths of said slots; and means for biasing said electrical heaters away from said covering means against the slots' bottoms.

7. The shaft bore heater assembly of claim 6, said covering means comprising:

insulation disposed on and attached to said surface in which said slots' open-mouths are exposed.

8. The shaft bore heater assembly of claim 6, said electrical heater biasing means comprising:

a plurality of spring members disposed between said electrical heaters and said covering means.

9. The shaft bore heater assembly of claim 6 further comprising:

a plurality of rigid spacer members disposed in said slots between and engageable with said electrical heaters and said heater biasing means.

* * * * *